United States Patent [19]

Usry

[11] Patent Number: 4,501,405

[45] Date of Patent: Feb. 26, 1985

[54] FRICTIONLESS VALVE/PUMP

[75] Inventor: Joe D. Usry, Midvale, Utah

[73] Assignee: Bunnell Life Systems, Inc., Salt Lake City, Utah

[21] Appl. No.: 506,215

[22] Filed: Jun. 21, 1983

[51] Int. Cl.[3] ..... F16L 55/14; F04B 43/12

[52] U.S. Cl. ..... 251/7; 417/412; 417/478; 417/474; 417/505

[58] Field of Search ..... 251/7, 138; 417/412, 417/474, 478, 505

[56] References Cited

U.S. PATENT DOCUMENTS

| | | | |
|---|---|---|---|
| 2,816,514 | 12/1957 | Freese | 417/412 |
| 3,171,360 | 3/1965 | Walton | 417/412 |
| 4,176,641 | 12/1979 | Citrin | 251/7 X |

FOREIGN PATENT DOCUMENTS

| | | | |
|---|---|---|---|
| 2820281 | 11/1979 | Fed. Rep. of Germany | 417/474 |

*Primary Examiner*—Richard E. Gluck

*Attorney, Agent, or Firm*—Thorpe, North & Western

[57] ABSTRACT

A valve having no friction producing components includes a flexible and resilient tube for carrying a fluid, an electrically energizable coil for producing an electromagnetic force when energized, a magnetically attractable element, and an elongate leaf spring attached near one end to the coil and looped outwardly, upwardly and back toward the coil, with the magnetically attractable element attached to the leaf spring near the other end. The leaf spring normally holds the magnetically attractable element out of contact with the coil, but when the coil is energized, the element is attracted towards the coil. The one end of the leaf spring attached to the coil is also formed to extend upwardly and over the magnetically attractable element to act as an anvil, and the other end of the leaf spring attached to the element extends upwardly towards the anvil to form a pinching tab. The tube is positioned between the anvil and pinching tab so that when the coil is de-energized, the tube is pinched closed between the tab and anvil. When the coil is energized, the element and pinching tab are attracted towards the coil and away from the anvil to release the tube and allow it to open.

5 Claims, 9 Drawing Figures

FRICTIONLESS VALVE/PUMP

BACKGROUND OF THE INVENTION

This invention relates to a simply constructed, long wear valve which may be utilized as a pump.

Valves are used in a multitude of environments to control the flow of fluids. Typically, valves utilize a sliding, rotating or other friction-producing part to effect the opening and closing of the channel through which the fluid flows. As a result, such valves tend to get hot with use, and this may alter the tolerances of the valves and thus the manner in which they operate. This can be a problem for precisely engineered systems which employ such valves since consistency and predictability of operation of the system and its components may be important. Also, because of the sliding, rotating, etc., parts, typical valves tend to rapidly wear out with frequent repetitive use. Valve failure could result in failure of an entire system in which such valves were used.

In selecting valves for use in medical or drug delivery systems, it is oftentimes necessary that the valves chosen be essentially noncontaminating. That is, the valves should not contact and contaminate the fluid whose flow is being controlled.

SUMMARY OF THE INVENTION

It is an object of the invention to provide an improved, highly reliable and long-lived valve.

It is also an object of the invention to provide a valve which has no sliding, rotating, rubbing or other friction-producing parts that will reduce cycle life or produce unanticipated failures.

It is a further object of the invention to provide a valve which is simple to construct and service.

It is another object of the invention to provide a valve which does not contact the fluid whose flow the valve controls.

It is still another object of the invention to provide a valve which can be constructed so that when it fails, it will fail safe, either in the closed or the open position as desired.

It is an additional object of the invention to provide a valve which is relatively quiet in operation.

The above and other objects of the invention are realized in a specific illustrative embodiment which includes a flexible and resilient tube for carrying a fluid, an electrically energizable coil for producing an electromagnetic force when energized, a magnetically attractable element, a resilient holding spring for holding the element in a position above the coil, and an anvil fixed adjacent to the holding spring and anvil. When the coil is energized, the element and holding spring are attracted to the coil to release and open the tube, and when the coil is de-energized, the holding spring and element move away from the coil toward the anvil to pinch and close the tube. Thus, the combination of the tube, coil, magnetically attractable element, holding spring and anvil provide a simple, noncontaminating, friction-free valve.

The valve of the present invention may be used to construct a pump which includes a flexible and resilient tube with three or more of the valves disposed in line along the tube to successively pinch and close the tube and release the tube in a predetermined pattern to cause fluid to move along in the tube.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
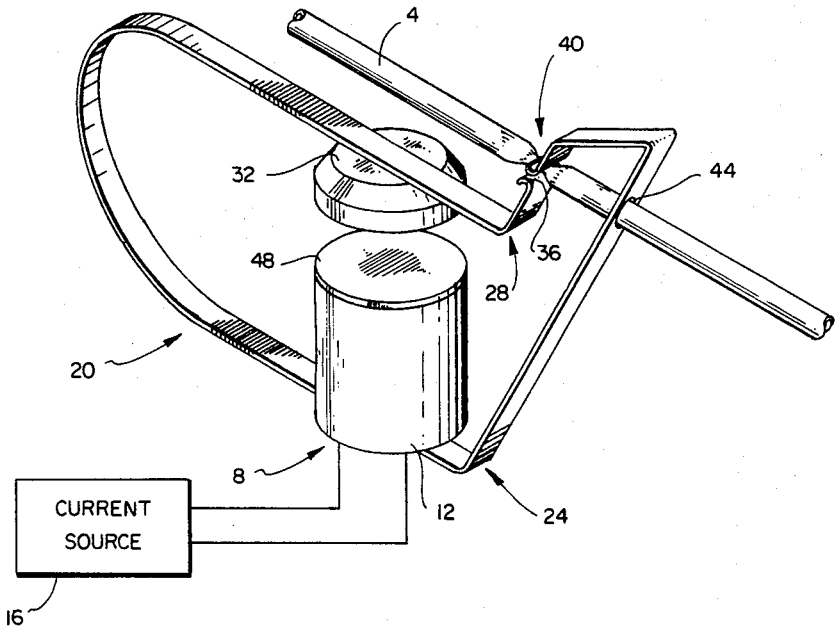
FIG. 1 is a perspective view of one embodiment of a valve made in accordance with the principles of the present invention.

FIG. 1 shows the valve of the present invention to include a flexible and resilient tube 4 made, for example, of rubber, styrene-butadiene, chloroprene, or other resilient material. The tube 4 is used to carry fluid whose flow is to be controlled, i.e., stopped, slowed, released, etc.

Also included is a conventional electromagnetic coil 8 wound in the form of a cylinder and encased in an electrically insulative housing 12. The coil is coupled to a current source 16 and, when current is supplied to the coil, the coil produces an electromagnetic attractive force operating along the cylindrical axis of the coil.

The coil 8 is mounted on an elongate, generally flat resilient leaf spring 20, near a first end 24 thereof. The leaf spring 20 is formed to curve outwardly of the coil, upwardly, and back toward a position above the coil, where it terminates in a second end 28. A magnetically attractable cap element 32 made, for example, of a nickel-iron alloy is attached at its upper surface to the leaf spring 20 in a position above the coil 8.

The second end 28 of the leaf spring 20 is formed to define an upwardly extending pinch tab 36 as shown. The first end 24 of the leaf spring 20 extends beyond the coil 8 and then is bent to extend upwardly and then back towards a position above the pinch tab 36 where it is formed into an upper stop or anvil 40. The tube 4 is positioned to extend between the pinch tab 36 and the anvil 40 through an opening 44 in the leaf spring.

Adhesively mounted on the top of the housing 12 is a pad 48 made, for example, of silicone rubber, felt, or similar soft and compliant material. The function of this pad is to reduce noise which might otherwise be caused by operation of the valve when the cap element 32 is attracted to the housing 12. The pad 48 could, alternatively, be placed on the bottom of the cap element 32 or on both the cap element and housing 12.

When the coil 8 is unenergized, the leaf spring 20 forces the pinch tab 36 towards the anvil 40 to pinch closed the tube 4 to prevent the flow of fluid therethrough. When the coil 8 is energized, i.e., supplied with electrical current, the magnetically attractable cap 32 is attracted towards the coil to thereby pull the pinch tab 36 away from the anvil 40 to release the tube 4 and allow fluid to flow therethrough. In this manner, a simply constructed valve is provided having no friction-producing components. Also, since no part of the valve contacts the fluid flowing through the tube 4, the valve is noncontaminating.

Figure 2:
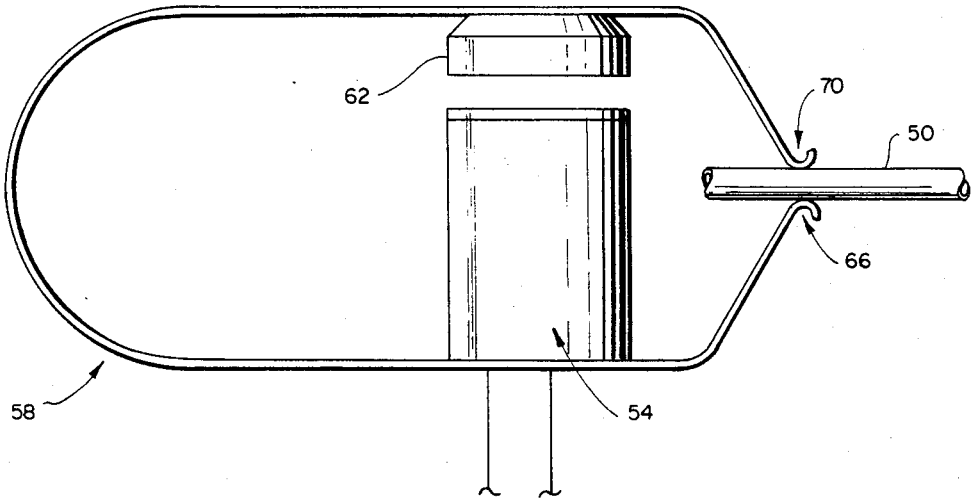
FIG. 2 is a side, elevational view of another embodiment of the valve.

FIG. 2 shows another embodiment of the valve of the present invention. In this embodiment, a tube 50 is pinched closed (rather than released to open) when an electrically energizable coil 54 is energized, and is released to open (rather than being pinched closed) when the coil 54 is deenergized. The coil 54 is again mounted on an elongate, generally flat resilient leaf spring 58. The leaf spring 58 is formed to curve outwardly, upwardly and then back towards a position above the coil 54, where a magnetically attractable cap element 62 is mounted. One end of the leaf spring 58 near where the coil 54 is mounted extends laterally outwardly and upwardly to form a fixed anvil 66. The other end of the leaf spring 58 extends laterally from the cap element 62 and then downwardly, with the end being formed into a pinch tab 70.

As is evident from FIG. 2, when the coil 54 is energized, the cap element 62 is attracted downwardly to force the pinch tab 70 towards the anvil 66 to pinch closed the tube 50. When the coil 54 is de-energized, the leaf spring 58 springs back to its normal position to cause the pinch tab 70 to move upwardly to release the tube 50.

The valve of the present invention can be made so that it fails in either the closed or open position. Thus, in the embodiment of FIG. 1, if there is a failure in the coil 8, the valve will be in the closed position—the tube 4 will be pinched closed. Whereas, if the coil 54 of the FIG. 2 embodiment fails, the valve will be in the open position—the tube 50 will be released from the pinched condition. Also, the friction-free nature of the valve eliminates the possibility that the valve might "stick" in an undesirable or unsafe position. The leaf springs 20 and 58 are sized in length, radius, width and thickness so that low spring stresses are produced along their lengths. This results in trouble free, long-lived operation. Exemplary dimensions for leaf springs made of stainless steel are ¾" width, 62/1000" thickness, 3.9" length, and a 0.625" radius of curvature of the curved position of the springs.

Figure 3:
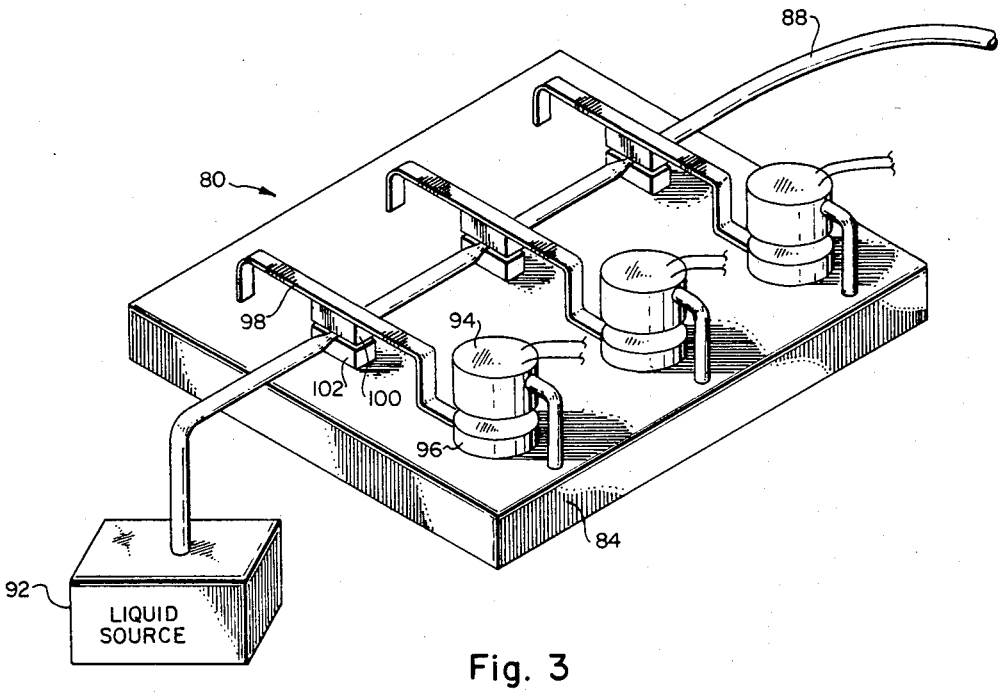
FIG. 3 is a perspective view of a liquid pump utilizing three of the valves of the present invention.
Figure 4A:
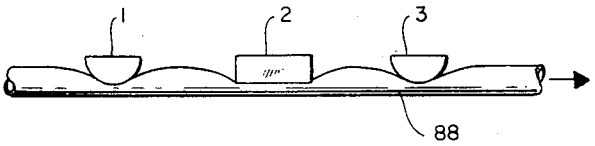
FIGS. 4*a*–4*f* are schematic illustrations showing six successive positions of the pump of FIG. 3 as it would be used to pump a liquid.
Figure 4B:
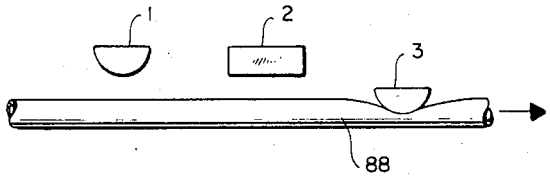
Figure 4C:
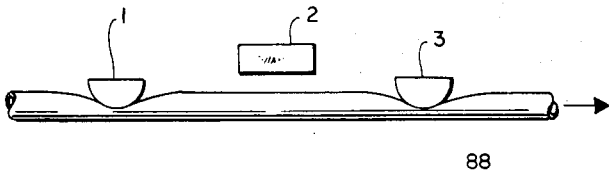
Figure 4D:
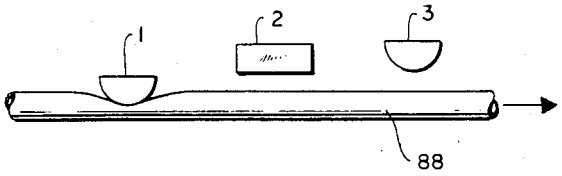
Figure 4E:
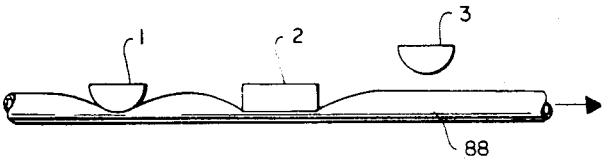
Figure 4F:
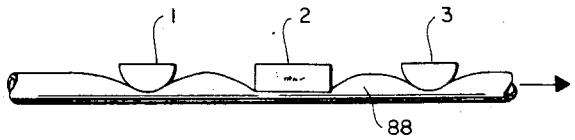

FIG. 3 shows a liquid pump 80 constructed from three valves of the present invention. The three valves are disposed on a base 84 generally in a line along a liquid-carrying tube 88. A liquid source 92 supplies the tube 88 with liquid under enough pressure so that the liquid would at least flow under such pressure through the tube 88 just beyond the pump 80.

Each of the valves mounted on the base 84 includes an electrically energizable coil 94 mounted in a fixed position on one side of the base 84, a magnetically attractable cap element 96 positioned just under above the coil, and a resilient leaf spring 98 mounted on the base 84 on the side opposite the location at which the coil 94 is mounted. The cap element 96 is attached to the leaf spring 98 so that when the coil 94 is energized, the cap element 96 will be attracted to the coil to pull up the leaf spring 98. Included with each valve are a pair of pinch pads 100 and 102, with pinch pad 100 being mounted on the under side of the leaf spring 98 and pinch pad 102 being mounted on the base 84 just below the pinch pad 100. The tube 88 extends between the pinch pads so that the tube is normally pinched closed when the coils 94 are unenergized. When the coils are energized, the tube is released to an "open" condition.

FIG. 4 shows schematically the sequence of operation of three valves 1, 2 and 3 for producing a pumping action for pumping fluid through the tube 88. In FIG. 4*a*, valves 1, 2 and 3 are all closed so that no fluid can flow through the tube. In FIG. 4*b*, valves 1 and 2 are open and valve 3 is closed so that fluid will flow to the right under pressure (or vacuum) from the liquid source to fill the tube 88 up to the location of valve 3. In FIG. 4*c*, valve 1 is closed to trap the fluid in the section of the tube 88 between valves 1 and 3. In FIG. 4*d*, valve 3 is opened to allow some of the fluid which before was trapped between valves 1 and 3 to flow to the right. In FIG. 4*e*, valve 2 is operated to force some additional fluid in the tube 88 to flow to the right, and then in FIG. 4*f*, valve 3 is operated to force still additional fluid to flow to the right and to prevent back flow. By successively operating the valves in the manner shown in FIG. 4, a pumping action is created to force fluid to flow through the tube 88 in the direction indicated.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A valve comprising a flexible and resilient tube for carrying a fluid, an electrically energizable coil for producing an electromagnetic force when energized, a magnetically attractable element, resilient holding means for normally holding the element in a first position above the coil so that when the coil is energized the element and holding means are attracted toward the coil, and when the coil is de-energized the holding means moves the element away from the coil back to the first position, wherein said holding means comprises an elongate leaf spring attached near one end to the coil and looped outwardly, upwardly and back toward the coil, with the magnetically attractable element attached to the leaf spring near the other end, and anvil means disposed adjacent to the holding means with the two being positioned to extend between the holding means and the anvil means so that the tube is alternately pinched closed against the anvil and released to open by the holding means as the coil is alternately energized and de-energized.

2. A valve as in claim 1 wherein said leaf spring is made of stainless steel.

3. A valve as in claim 1 wherein said anvil means is formed from said leaf spring, wherein said one end of the leaf spring extends upwardly to a position above the magnetically attractable element, and wherein the other end of the leaf spring extends from the point of attachment to said element toward said one end of the leaf spring so that when the coil is energized, said other end of the leaf spring is moved away from said one end to release the tube.

4. A valve as in claim 1 wherein said anvil means is formed from said leaf spring, wherein said one end of the leaf spring extends upwardly to a position at one side of the magnetically attractable element, and wherein the other end of the leaf spring extends beyond the point of attachment to said element to a position above said one end of the leaf spring so that when the coil is energized, said other end of the leaf spring is moved toward said one end to pinch the tube therebetween.

5. A valve as in claim 1 wherein said anvil means is positioned so that when the coil is energized, the holding means is caused to move toward the anvil means to pinch the tube.

* * * * *